US008292343B2

(12) United States Patent
Hsu

(10) Patent No.: US 8,292,343 B2
(45) Date of Patent: Oct. 23, 2012

(54) CHOPSTICKS

(76) Inventor: Tung Yu Hsu, Taichung (TW)

( * ) Notice: Subject to any disclaimer, the term of this patent is extended or adjusted under 35 U.S.C. 154(b) by 0 days.

(21) Appl. No.: 13/364,341

(22) Filed: Feb. 2, 2012

(65) Prior Publication Data

US 2012/0133166 A1 May 31, 2012

Related U.S. Application Data

(63) Continuation-in-part of application No. 12/622,434, filed on Nov. 20, 2009, now abandoned.

(51) Int. Cl.
*A47G 21/10* (2006.01)

(52) U.S. Cl. ..... 294/218

(58) Field of Classification Search ..... 294/218
See application file for complete search history.

(56) References Cited

U.S. PATENT DOCUMENTS

| | | | | |
|---|---|---|---|---|
| 2009/0108600 | A1* | 4/2009 | Ichinose | 294/1.1 |
| 2009/0121501 | A1* | 5/2009 | Liu | 294/1.1 |
| 2009/0165307 | A1* | 7/2009 | Lam et al. | 30/123 |
| 2011/0042977 | A1* | 2/2011 | Shen | 294/1.1 |

FOREIGN PATENT DOCUMENTS

JP 2000210184 A * 8/2000

* cited by examiner

*Primary Examiner* — Saul Rodriguez
*Assistant Examiner* — Gabriela Puig

(57) ABSTRACT

Each of a pair of chopsticks includes a food-carrying portion formed on a first end thereof, and a magnetic portion formed on a second end thereof opposite to the first end. The magnetic portion has a receiving space defined therein and a magnet received in the receiving space. The magnetic portion has a tapered section disposed on an outer periphery thereof and corresponding to the magnet. The tapered section gradually tapered toward a distal end of the second end. When the two magnets of the chopsticks magnetically attract each other, the two tapered sections of the chopsticks contact with each other and the two food-carrying portions are separated automatically. The two food-carrying portions are able to pivotally move toward/outward each other.

6 Claims, 12 Drawing Sheets

CHOPSTICKS

CROSS-REFERENCE TO RELATED APPLICATION

This application is a Continuation-In-Part Application of Ser. No. 12/622,434, filed 20 Nov. 2009, now abandoned, and entitled "CHOPSTICKS".

BACKGROUND OF THE INVENTION

1. Field of the Invention

The present invention relates to a pair of chopsticks, and more particularly to each chopstick having a magnet disposed thereon.

2. Description of Related Art

Each of a pair of conventional chopsticks eating utensils in accordance with the prior art generally includes an elongated, hollow tube formed of rigid non-toxic plastic. The elongated, hollow tube has a lower closed end and an upper closed end. The tube has a sidewall of sufficient thickness to make the tube rigid. The tube has an intermediate corrugated portion disposed near said lower closed end. The intermediate corrugated portion comprises a series of axially spaced corrugations extending substantially entirely about said sidewall.

However, when a user holds the conventional chopsticks for grasping food, the tube only has an intermediate corrugated portion for preventing food from dropping. The tube does not have any structure to prevent either chopstick from easily dropping. It is inconvenient for the user to use the chopsticks.

The present invention has arisen to mitigate and/or obviate the disadvantages of the conventional chopsticks.

SUMMARY OF THE INVENTION

The main objective of the present invention is to provide a pair of improved chopsticks.

To achieve the objective, each of the chopsticks in accordance with the present invention includes a food-carrying portion formed on a first end thereof, a magnetic portion formed on a second end thereof opposite to the first end, the magnetic portion having a receiving space defined therein and a magnet received in the receiving space, the magnetic portion having a tapered section disposed on an outer periphery thereof, the tapered section tapered with a tapered angle θ toward a distal end of the second end opposite to the first end; wherein when the two magnets of the chopsticks magnetically attract each other, the two tapered sections of the chopsticks facially contact with each other and the two food-carrying portions are pivotally separated, the two food-carrying portions being able to pivotally move toward/outward each other; thereby when a user grips the chopsticks in one hand for grasping a food, the two food-carrying portions are able to pivotally move toward/outward each other about the tapered sections for picking up or releasing the food; the two food-carrying portions are able to automatically move outward, from each other with the opening angle to release the food due to a magnetic attraction between the tapered sections.

The tapered section is corresponding to the magnet.

The tapered angle θ is limited within 15 degrees such that an opening angle 2θ of the chopsticks not over 30 degrees.

Each chopstick is in an elongated cylindrical shape, each magnetic portion having an outer diameter relatively greater than an outer diameter of the food-carrying portion.

Each chopstick has a holding portion formed thereon and located adjacent to the magnetic portion, the holding portion having an outer diameter relatively smaller than the outer diameter of the magnetic portion.

Each chopstick is in an elongated rectangular shape, each magnetic portion having a width relatively greater than a width of the food-carrying portion.

The magnetic portion has an annular protrusion disposed thereon, a top of the magnet being above the annular protrusion, the tapered section formed as a cone surface on an outer periphery of the annular protrusion, the tapered section below the top of the magnet.

Further benefits and advantages of the present invention will become apparent after a careful reading of the detailed description with appropriate reference to the accompanying drawings.

DETAILED DESCRIPTION OF THE INVENTION

Figure 1:
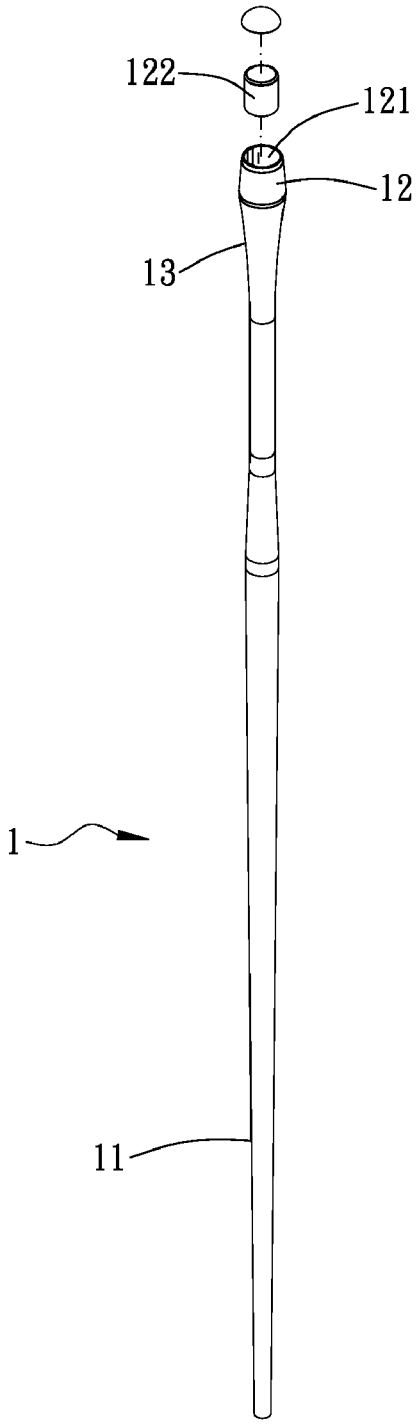
FIG. 1 is an exploded perspective view of a preferred embodiment of one of a pair of chopsticks in accordance with the present invention.
Figure 2:
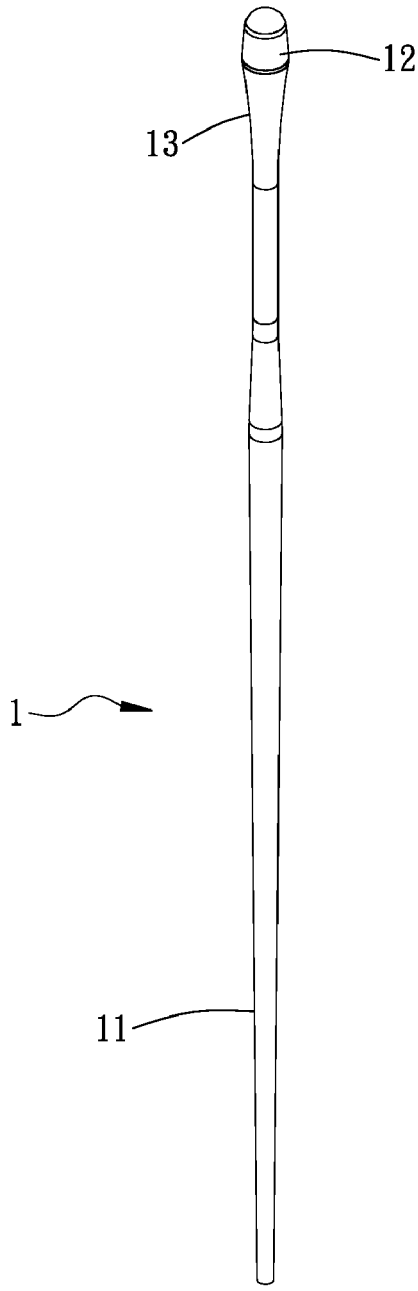
FIG. 2 is an assembled perspective view of the preferred embodiment of one of the chopsticks in accordance with the present invention.
Figure 3:
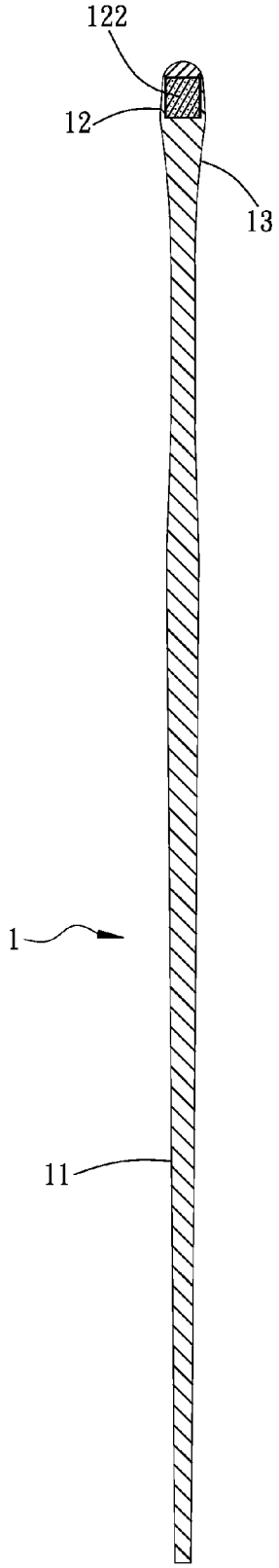
FIG. 3 is an assembled cross-sectional plane view of the preferred embodiment of one of the chopsticks in accordance with the present invention.
Figure 4:
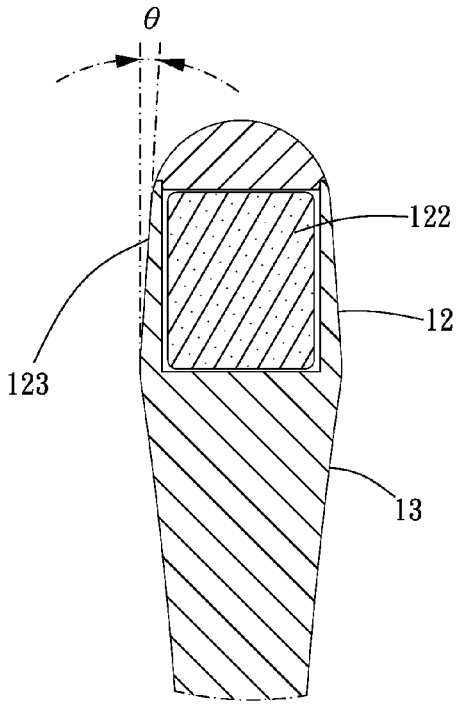
FIG. 4 is an enlarged cross-sectional plane view of the preferred embodiment of a magnetic portion of one of the chopsticks in accordance with the present invention.
Figure 5:
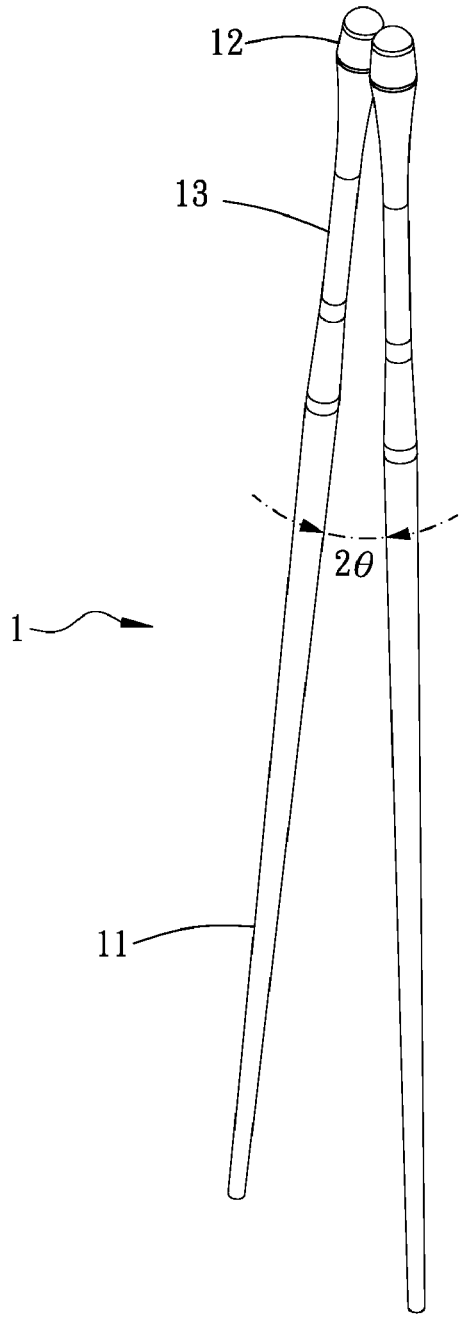
FIGS. 5-8 are operational perspective views of the preferred embodiment of the chopsticks in accordance with the present invention.
Figure 6:
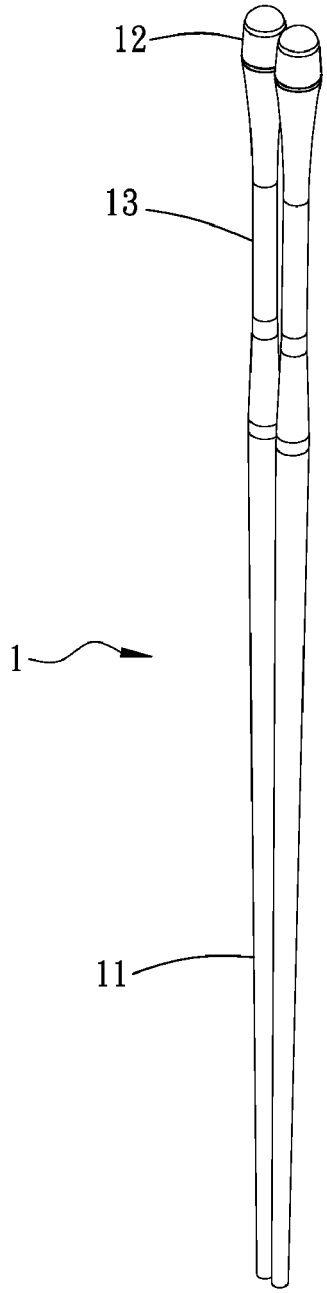
Figure 7:
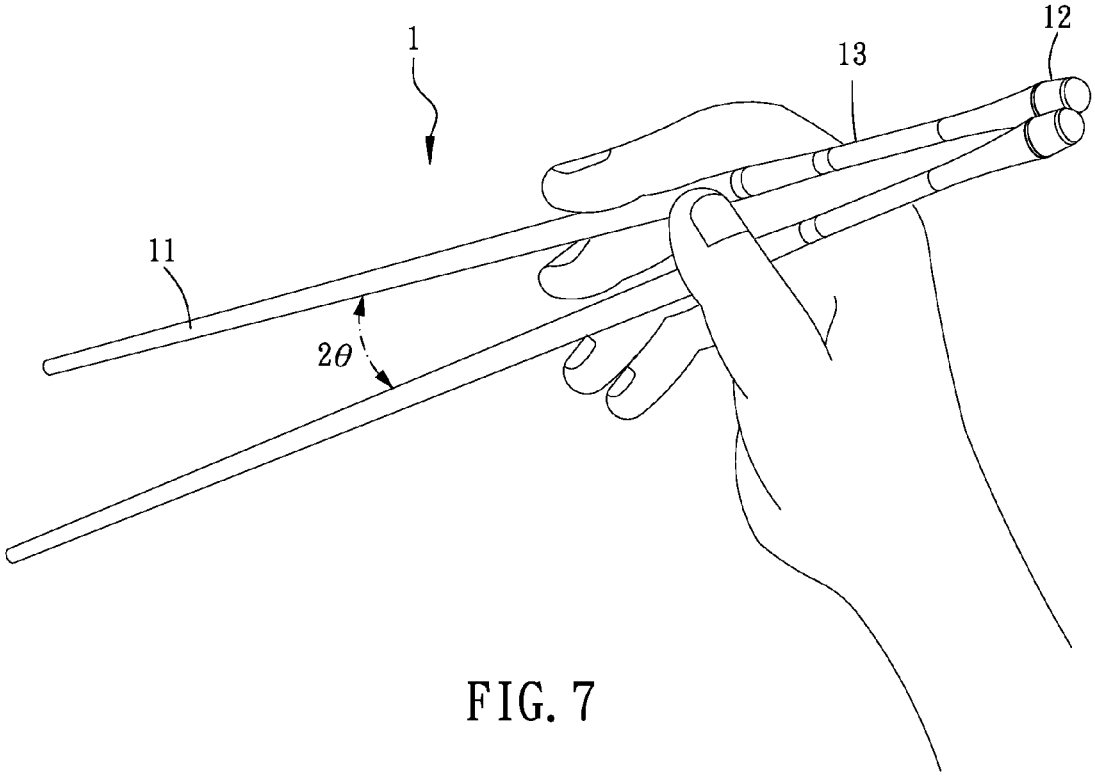
Figure 8:
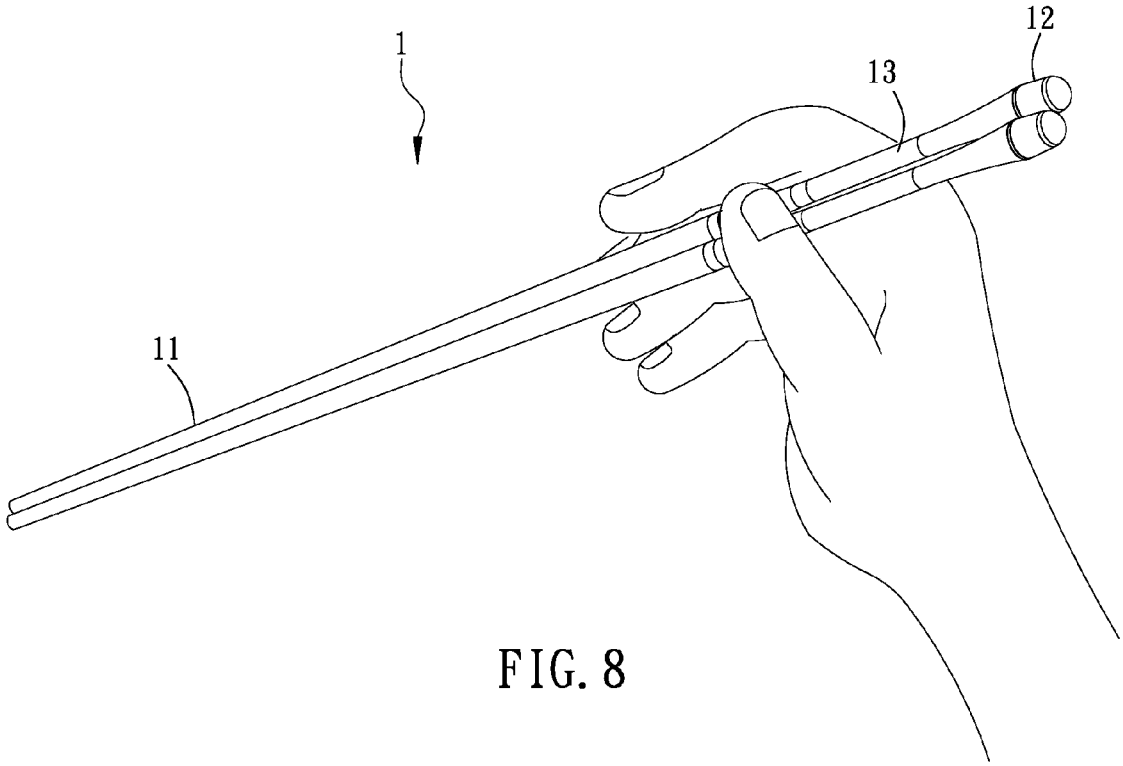
Figure 9:
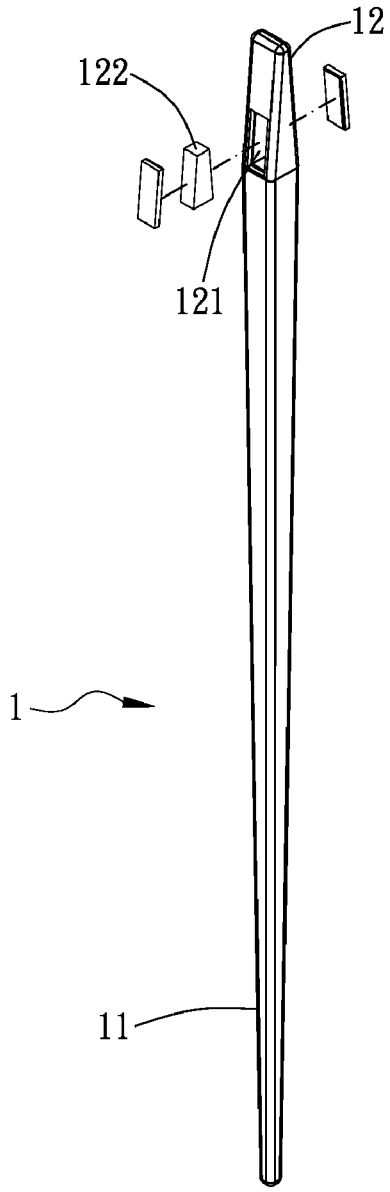
FIG. 9 is an exploded perspective view of a second embodiment of one of the chopsticks in accordance with the present invention.

Referring to the drawings and initially to FIGS. 1-8, each of a pair of chopsticks in accordance with the present invention comprises a food-carrying portion 11 formed on a first end thereof, and a magnetic portion 12 formed on a second end thereof opposite to the first end. Each chopstick 1 is in an elongated cylindrical shape and the magnetic portion 12 has an outer diameter relatively greater than an outer diameter of the food-carrying portion 11.

The magnetic portion 12 of each chopstick 1 has a receiving space 121 longitudinally defined in a distal end thereof. A magnet 122 is received in the receiving space 121. The magnetic portion 12 has a tapered section 123 (shown in FIG. 4) annularly disposed on an outer periphery thereof and corresponding to a location of the magnet 122. The tapered section 123 is tapered with a tapered angel θ toward the distal end of the magnetic portion 12. The tapered angle θ of the tapered section 123 is limited within 15 degrees so that an opening angle 2θ of the chopsticks 1 is not over 30 degrees.

Moreover, each chopstick 1 has a holding portion 13 formed thereon and located adjacent to the magnetic portion 12. The holding portion 13 has an outer diameter relatively smaller than the outer diameter of the magnetic portion 12, such that a user can easily and comfortably grip the holding portions 13 of the chopsticks 1.

When the two magnets 122 of the chopsticks 1 magnetically attract each other, the two tapered sections 123 (shown in FIG. 4) of the chopsticks 1 facially contact with each other and the two food-carrying portions 11 pivotally are separated. When the user grips the chopsticks 1 in one hand for grasping a food, the two food-carrying portions 11 are able to pivotally move toward/outward each other about the tapered sections 123 for picking up or releasing the food. After releasing the food, the two food-carrying portions 11 are able to automatically move outward from each other due to a magnetic attraction between the tapered sections 123. During eating, the two magnetic portions 12 which are magnetically and mutually attracted to each other would not separate from each other. The user does not need to worry that either chopstick 1 would drop.

Figure 10:
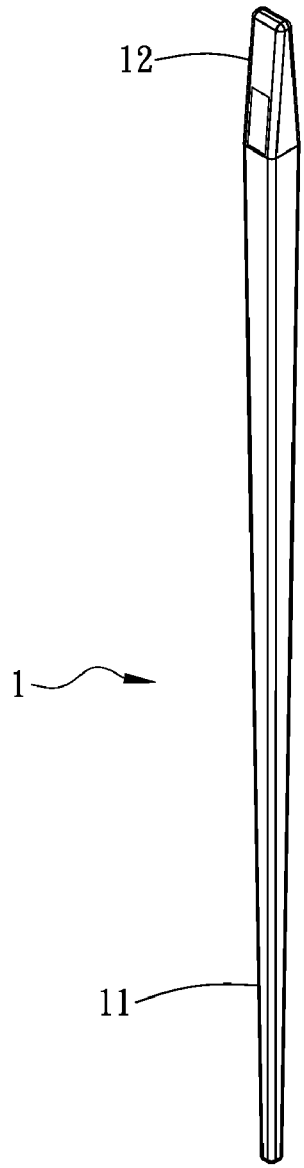
FIG. 10 is an assembled perspective view of the second embodiment of one of the chopsticks in accordance with the present invention.
Figure 11:
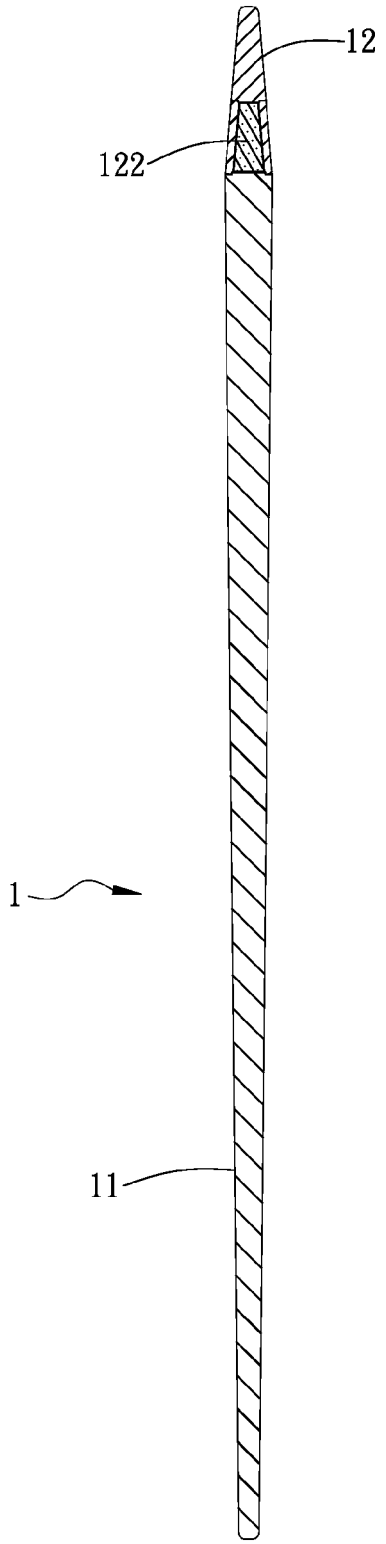
FIG. 11 is an assembled cross-sectional plane view of the second embodiment of one of the chopsticks in accordance with the present invention.
Figure 12:
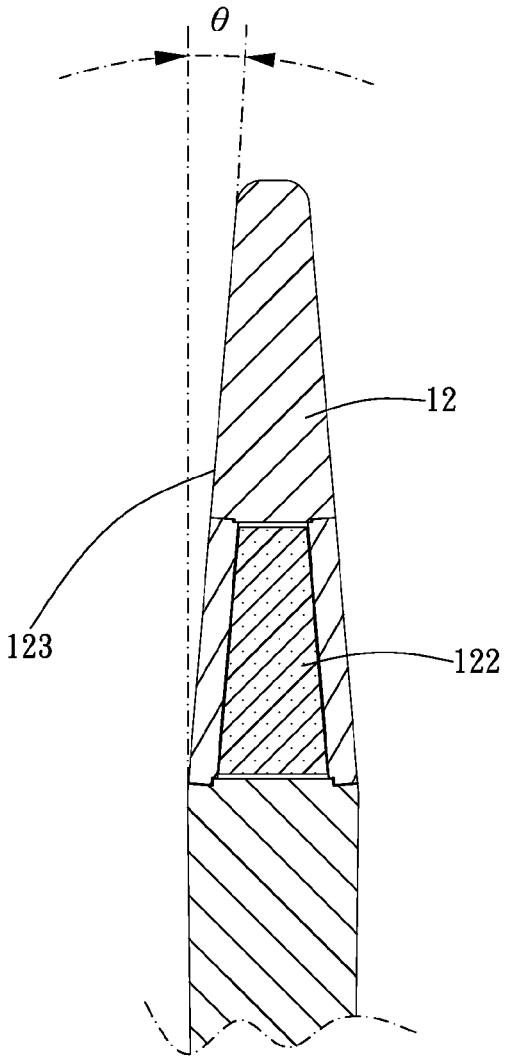
FIG. 12 is an enlarged cross-sectional plane view of the second embodiment of the magnetic portion of one of the chopsticks in accordance with the present invention.
Figure 13:
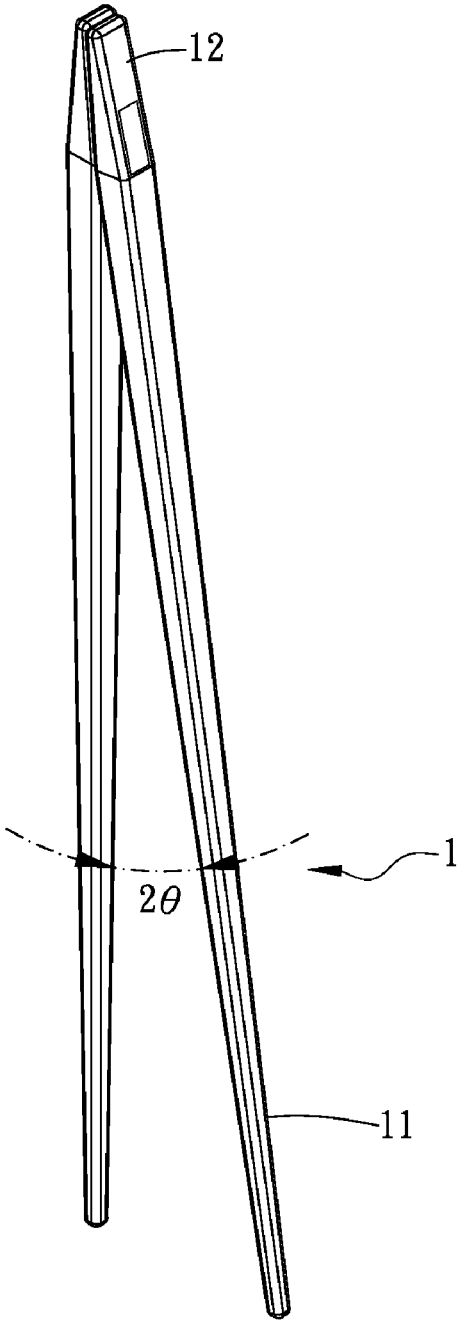
FIGS. 13-14 are operational perspective views of the second embodiment of the chopsticks in accordance with the present invention.
Figure 14:
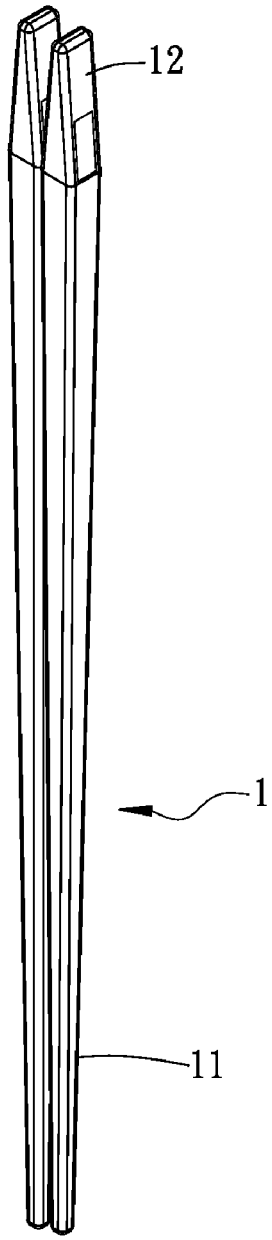

With reference to FIGS. 10-14, those show a second embodiment of the chopsticks in accordance with the present invention. The elements and effects of the second embodiment which are the same with the preferred embodiment are not described, only the differences are described. In this embodiment, each chopstick 1 is in an elongated rectangular shape. Each magnetic portion 12 has a width relatively greater than a width of the food-carrying portion 11. The receiving space 121 is laterally defined in the magnetic portion 12. The magnet 122 is sealingly received in the receiving space 121. The tapered section 123 (shown in FIG. 12) is disposed on two opposite surfaces of the magnetic portions 12 and corresponds to the magnet 122.

Figure 15:
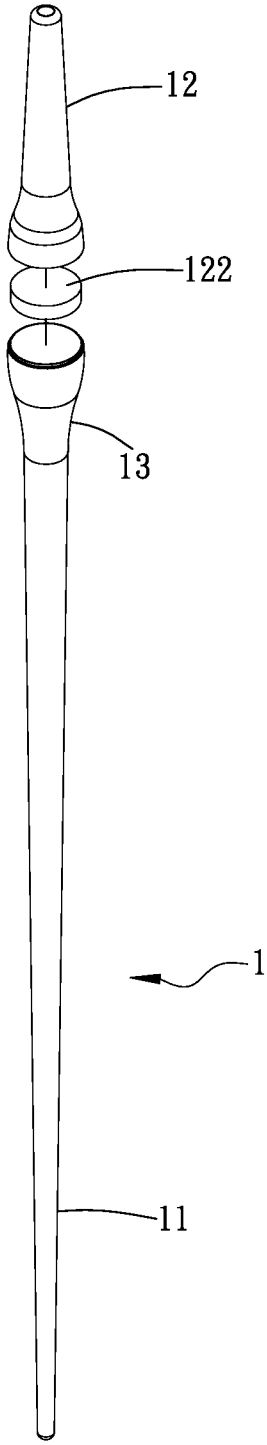
FIG. 15 is an exploded perspective view of a third embodiment of one of the chopsticks in accordance with the present invention.
Figure 16:
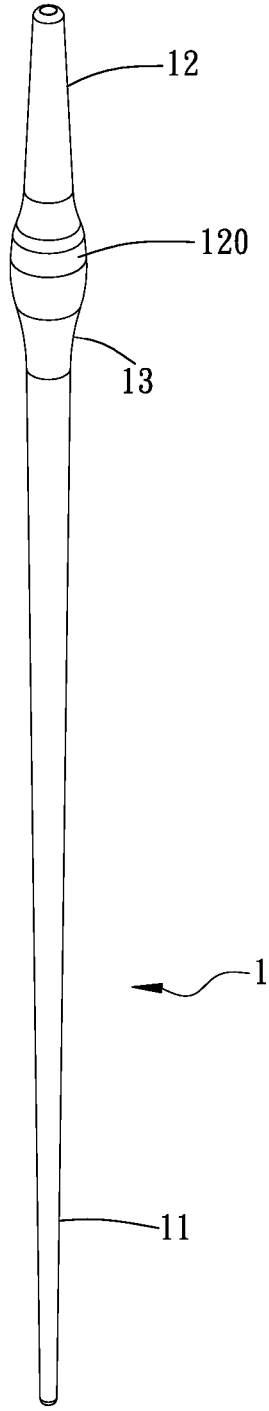
FIG. 16 is an assembled perspective view of the third embodiment of one of the chopsticks in accordance with the present invention.
Figure 17:
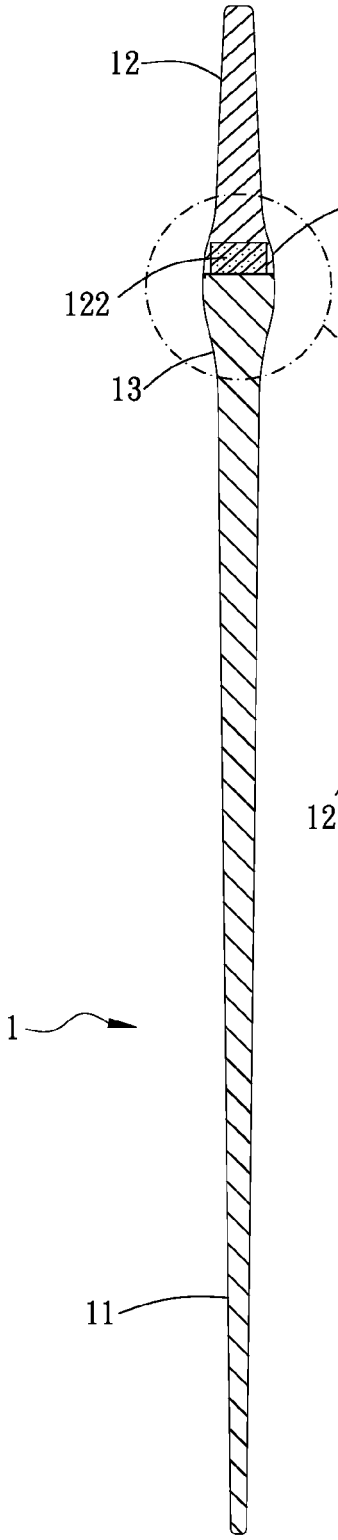
FIG. 17 is an assembled cross-sectional plane view of the third embodiment of one of the chopsticks in accordance with the present invention.
Figure 18:
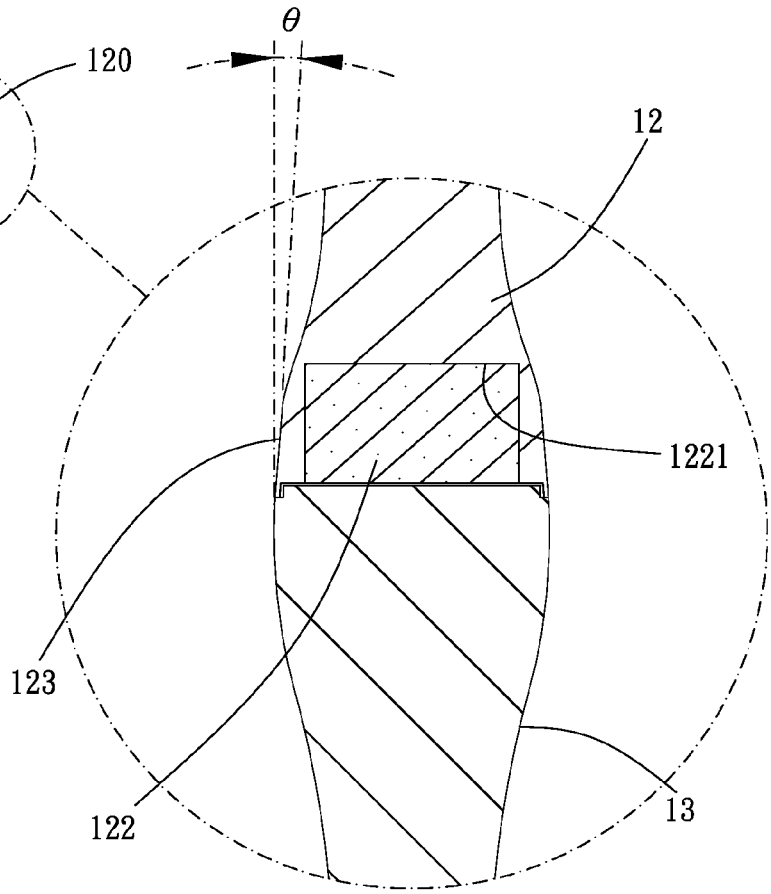
FIG. 18 is an enlarged cross-sectional plane view of the third embodiment of an annular protrusion of one of the chopsticks in accordance with the present invention.
Figure 19:
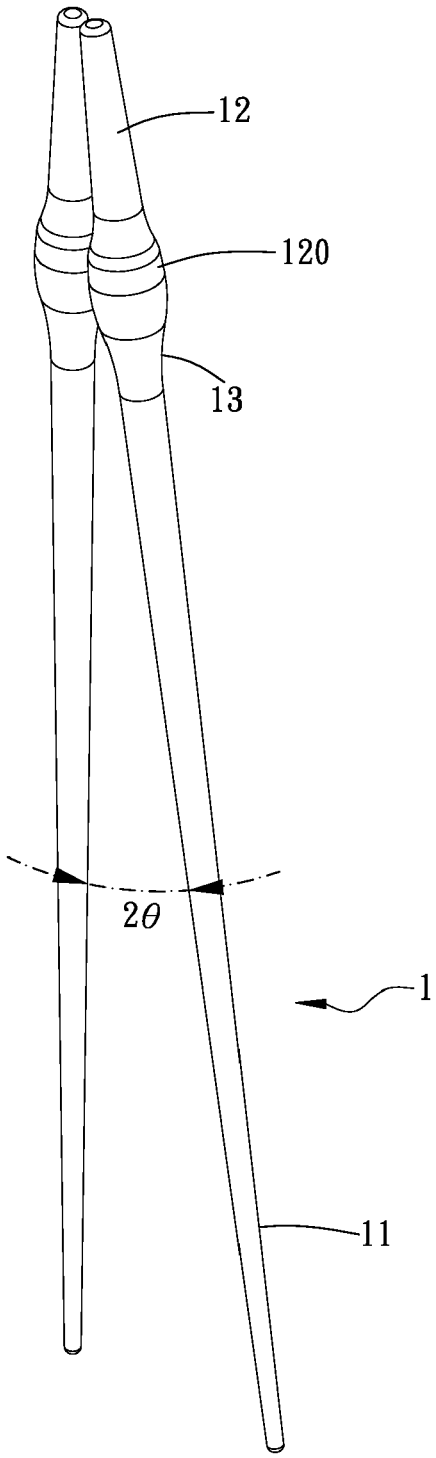
FIGS. 19-20 are operational perspective views of the third embodiment of the chopsticks in accordance with the present invention.
Figure 20:
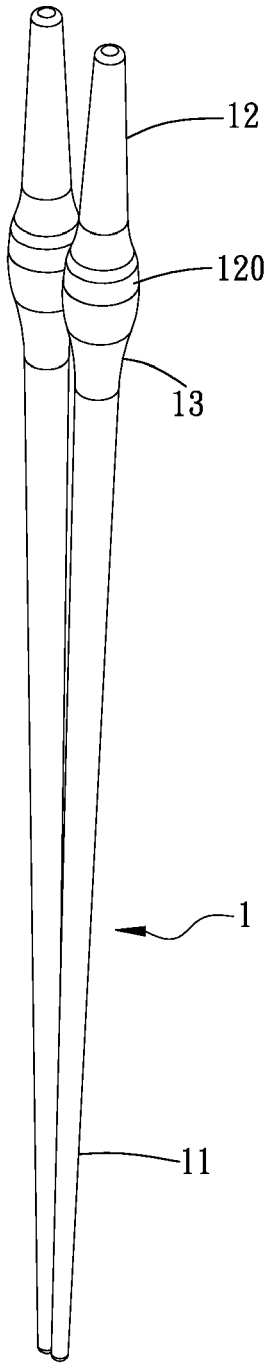
Figure 21:
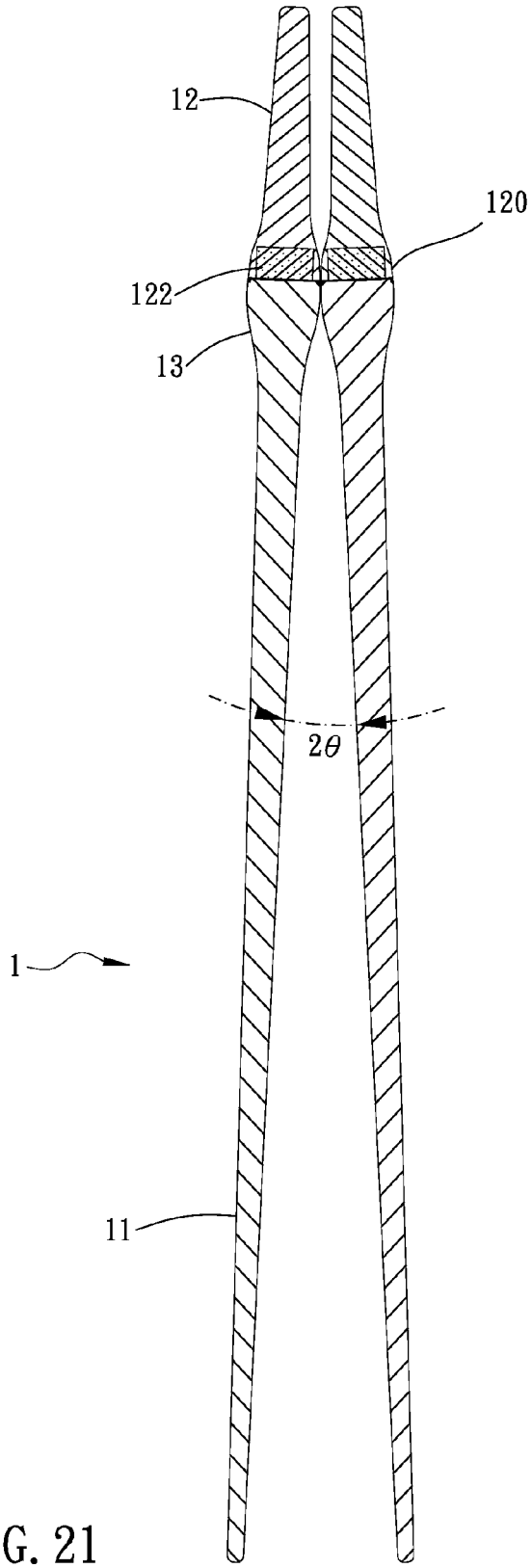
FIG. 21 is an operational cross-sectional plane view of the third embodiment of the chopsticks in accordance with the present invention.

With reference to FIGS. 15-21, those show a third embodiment of the chopsticks in accordance with the present invention. The elements and effects of the third embodiment which are the same with the preferred embodiment are not described, only the differences are described. In this embodiment, the magnetic portion 12 has an annular protrusion 120 disposed thereon. A top of the magnet 1221 is above the annular protrusion 120. The tapered section 123 is formed as a cone surface on an outer periphery of the annular protrusion 120. The tapered section 123 is below the top of the magnet 1221.

Although the invention has been explained in relation to its preferred embodiment, it is to be understood that many other possible modifications and variations can be made without departing from the spirit and scope of the invention as hereinafter claimed.

What is claimed is:

1. A pair of chopsticks, each chopstick comprising:

a food-carrying portion formed on a first end thereof; and a magnetic portion formed on a second end thereof opposite to the first end, the magnetic portion having a receiving space defined therein and a magnet received in the receiving space, the magnetic portion having a tapered section disposed on an outer periphery thereof, the tapered section tapered with a tapered angle θ toward a distal end of the second end opposite to the first end, the magnetic portion having an annular protrusion disposed thereon, a top of the magnet being above the annular protrusion, the tapered section formed as a cone surface on an outer periphery of the annular protrusion, the tapered section below the top of the magnet;

wherein when the two magnets of the chopsticks magnetically attract each other, the two tapered sections of the chopsticks facially contact with each other and the two food-carrying portions are pivotally separated, the two food-carrying portions being able to pivotally move toward/outward each other; thereby when a user grips the chopsticks in one hand for grasping a food, the two food-carrying portions are able to pivotally move toward/outward each other about the tapered sections for picking up or releasing the food; the two food-carrying portions are able to automatically move outward from each other with the opening angle to release the food due to a magnetic attraction between the tapered sections.

2. The chopsticks as claimed in claim 1, wherein the tapered section is corresponding to the magnet.

3. The chopsticks as claimed in claim 2, wherein each chopstick has a holding portion formed thereon and located adjacent to the magnetic portion, the holding portion having an outer diameter relatively smaller than a further outer diameter of the magnetic portion.

4. The chopsticks as claimed in claim 1, wherein the tapered angle θ is limited within 15 degrees such that an opening angle 2θ of the chopsticks not over 30 degrees.

5. The chopsticks as claimed in claim 1, wherein each chopstick is in an elongated cylindrical shape, each magnetic portion having an outer diameter relatively greater than an outer diameter of the food-carrying portion.

6. The chopsticks as claimed in claim 1, wherein each chopstick is in an elongated rectangular shape, each magnetic portion having a width relatively greater than a width of the food-carrying portion.

* * * * *